US007828253B2

(12) United States Patent
Meyer

(10) Patent No.: US 7,828,253 B2
(45) Date of Patent: Nov. 9, 2010

(54) SECURE SHELF FOR TECHNOLOGY WORKSTAND

(76) Inventor: Christopher E. Meyer, 17233 Newhope St., Suite C, Fountain Valley, CA (US) 92708

( * ) Notice: Subject to any disclaimer, the term of this patent is extended or adjusted under 35 U.S.C. 154(b) by 602 days.

(21) Appl. No.: 11/820,638

(22) Filed: Jun. 20, 2007

(65) Prior Publication Data

US 2008/0001043 A1 Jan. 3, 2008

Related U.S. Application Data

(60) Provisional application No. 60/815,088, filed on Jun. 20, 2006.

(51) Int. Cl.

| | |
|---|---|
| ***A47K 1/04*** | (2006.01) |
| ***A47K 1/00*** | (2006.01) |
| ***A47K 5/00*** | (2006.01) |
| ***A47B 96/00*** | (2006.01) |
| ***A47B 81/00*** | (2006.01) |
| ***E04G 5/06*** | (2006.01) |
| ***F21V 21/00*** | (2006.01) |
| ***F16M 11/00*** | (2006.01) |
| ***F16M 13/00*** | (2006.01) |
| ***F16L 3/08*** | (2006.01) |

(52) U.S. Cl. ..... 248/129; 248/224.8; 248/157; 248/161; 248/176.1; 248/551; 248/346.03; 248/346.01; 108/50.01; 312/208.1; 312/223.3; 312/249.9; 312/249.11

(58) Field of Classification Search ..... 248/129, 248/522, 346.06, 222.51, 224.8, 17.35, 157, 248/161, 176.1, 551, 346.03, 346.01, 187.1; 108/116, 50.1, 93, 147, 50.2, 106, 108; 600/47, 600/300, 411, 425; 312/208.1, 208.2, 208.3, 312/223.3, 235.9, 249.9, 249.11

See application file for complete search history.

(56) References Cited

U.S. PATENT DOCUMENTS

| | | | | |
|---|---|---|---|---|
| 4,549,727 | A | 10/1985 | Kozar | |
| 5,085,395 | A * | 2/1992 | Frater et al. | 248/552 |
| 5,595,074 | A | 1/1997 | Munro | |

(Continued)

OTHER PUBLICATIONS a2z Mobile Office Solutions. "a2z Laptop Secure LocDown." Copyright 1995-2005, Jun. 19, 2007. 2 pages. <http:l/www.a2z solutions.com/computer/security/secure_locdown.htm>.

(Continued)

*Primary Examiner*—Anita M King
*Assistant Examiner*—Christopher Garft

(57) ABSTRACT

A portable laptop computer stand comprises a support assembly mounted atop a pedestal. The pedestal includes a base assembly having a post extending upwardly therefrom. The base assembly is supported by a plurality of radially outwardly extending spokes having castors mounted on free ends thereof. The post may include a telescopic mechanism to allow for vertical height adjustment of the support assembly. The support assembly includes a support panel atop of which is mounted the laptop computer in a secured manner via a pair security devices mounted on opposing sides thereof. The support assembly may further include a pull-out drawer, pull-out keyboard tray having a pull-out mouse panel.

19 Claims, 3 Drawing Sheets

U.S. PATENT DOCUMENTS

| | | | | |
|---|---|---|---|---|
| 5,655,743 | A * | 8/1997 | Gillis | 248/346.01 |
| 5,697,233 | A * | 12/1997 | Albert et al. | 70/58 |
| 5,839,713 | A | 11/1998 | Wright | |
| 6,079,676 | A * | 6/2000 | Hackett et al. | 248/118 |
| 6,308,928 | B1 * | 10/2001 | Galant | 248/553 |
| 6,443,417 | B2 | 9/2002 | Galant | |
| 6,443,543 | B1 * | 9/2002 | Chiang | 312/223.3 |
| 6,488,256 | B1 | 12/2002 | Chang | |
| 6,491,268 | B1 * | 12/2002 | Channer et al. | 248/176.1 |
| 6,493,220 | B1 * | 12/2002 | Clark et al. | 361/679.41 |
| 7,032,872 | B2 | 4/2006 | Sullivan | |
| 7,174,752 | B2 * | 2/2007 | Galant | 70/58 |
| 7,658,363 | B2 * | 2/2010 | Meyer | 248/551 |
| 2003/0034429 | A1 | 2/2003 | Carnevali | |
| 2003/0164010 | A1 * | 9/2003 | Galant | 70/58 |
| 2004/0186357 | A1 * | 9/2004 | Soderberg et al. | 600/300 |
| 2004/0261474 | A1 * | 12/2004 | Galant | 70/58 |
| 2004/0262867 | A1 * | 12/2004 | Arceta et al. | 280/47.35 |
| 2005/0178298 | A1 * | 8/2005 | Rossini | 108/50.01 |
| 2005/0288571 | A1 * | 12/2005 | Perkins et al. | 600/407 |
| 2007/0227409 | A1 * | 10/2007 | Chu | 108/50.02 |
| 2008/0084147 | A1 * | 4/2008 | Brown | 312/223.3 |

OTHER PUBLICATIONS

LocDown.com. "Secure Media Cart." Copyright 2006-2007. Nov. 1, 2007. 4 pages. <http://www.locdown.com/media-cart-loc.htm>.

* cited by examiner

SECURE SHELF FOR TECHNOLOGY WORKSTAND

CROSS-REFERENCE TO RELATED APPLICATIONS

This application claims the benefit of U.S. Provisional Application No. 60/815,088, filed Jun. 20, 2006, and is related to U.S. application Ser. No. 11/820,687 entitled LAPTOP SECURITY DEVICE FOR TECHNOLOGY WORKSTAND filed on Jun. 20, 2007, the entire contents of both applications being incorporated by reference herein.

STATEMENT RE: FEDERALLY SPONSORED RESEARCH/DEVELOPMENT (Not Applicable)

BACKGROUND

The present invention relates generally to portable stands and, more particularly, to a securable shelf for a technology workstand such as a portable laptop computer stand. The secure shelf or support assembly may be used for supporting the laptop computer and is configured to be adaptable for a variety of different sizes of laptop computers. The secure shelf includes a security device for securing an object such as the laptop computer to the support assembly when the laptop computer is in the open position.

In the healthcare industry, patient diagnosis and the need to access medical records occurs in an increasingly wide variety of settings. For example, many hospitals perform diagnostic procedures in a variety of rooms such as patient, emergency and operating rooms, as well as in laboratories, radiology departments and nurse stations. In each of these point-of-care locations, it is desirable to have immediate access to patient data, images and other medical documents.

In response to the increasing variety of patient treatment settings, portable work stations have been developed for use in the medical field. For example, some prior art portable work stations are arranged as cabinet-like structures having castors in order to facilitate transportation from one area of a hospital to another area. Appropriate computer-related equipment such as a personal computer having a self-contained power source may be included in the cabinet-like structure such that the work station may be moved from one patient room to another patient room to provide the capability to access patient records for the particular patient.

Unfortunately, such cabinet-like structures, while providing enhanced convenience due to their portability, present certain deficiencies relating to their bulk and size that make it cumbersome to move them from location to location. Furthermore, because the cabinet-mounted computer is accessible in a semi-public (i.e., hospital) setting, theft of a laptop computer itself significantly concerns large entities such as hospitals and other large organizations that purchase large quantities of such work stations.

As can be seen, there exists a need in the art for a portable computer stand that can mount certain computer related components such as laptop computers for transportability between various locations in a medical institution. Furthermore, there exists a need in the art for a portable computer stand that is convenient to use and which provides a support for the laptop computer while safeguarding against removal or theft of the laptop computer.

BRIEF SUMMARY

The above described deficiencies associated with portable computer stands of the prior art are specifically addressed and alleviated by the present invention which provides a support assembly such as for a portable laptop computer stand and which is specifically adapted to allow for secured mounting of a variety of different sizes and configurations of portable devices such as laptop computers, and which further includes a plurality of pull-out features such as a keyboard tray, mouse tray, and pull-out drawer to facilitate use of the portable computer stand in point-of-care applications typical of modern medical facilities.

The portable laptop computer stand comprises a support assembly mounted atop a pedestal. The pedestal itself comprises a post having a telescopic mechanism interposed therewithin to provide for height adjustment for users of different height. Furthermore, the pedestal includes a base assembly having a plurality of radially outwardly extending spokes each having a wheel such as a castor wheel mounted thereon to enhance transportability of the portable laptop computer stand.

In addition, the support assembly includes a support panel which is specifically adapted to provide for secure mounting of a laptop computer in its open position to prevent theft during the laptop computer's use. The support assembly may also provide a pull-out drawer which is slideable out of a front end of the support assembly and which may be used to store medicine and other medical-related items. Additionally, the support assembly may include an additional pull-out keyboard tray also slideable out of the front end of the support assembly.

The pull-out keyboard tray is preferably configured such that a full size keyboard may be installed thereinto and which may be operatively connected to the laptop in order to facilitate operation of the laptop computer. The pull-out keyboard tray may optionally further include a palm rest in order to facilitate ease of use of the keyboard installed in the pull-out keyboard tray. Additionally, the pull-out keyboard tray may include a pull-out mouse tray configured to extend laterally outwardly from the pull-out keyboard tray when the pull-out keyboard tray is placed in the open position.

Advantageously, the support panel mounted atop the support assembly includes at least one laterally outwardly extending tab which passes through a slot formed in a back wall of the support assembly. Holes formed in corresponding positions on each of the tabs of the support panel and back wall allow for engagement of a locking member such as a padlock thereto to prevent removal of the support panel and, hence, removal of the laptop computer from the support assembly.

Advantageously, the locking mechanism allows for securing of the laptop computer via a pair of security devices disposed on opposing sides of the laptop. Such security devices are secured to the support panel by means of mechanical fasteners extending upwardly from a lower surface of the support panel into the security devices. In this manner, the inaccessibility of the mechanical fasteners which attach the security device to the support panel by virtue of the locking member (e.g., padlock) prevents removal of the laptop computer.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
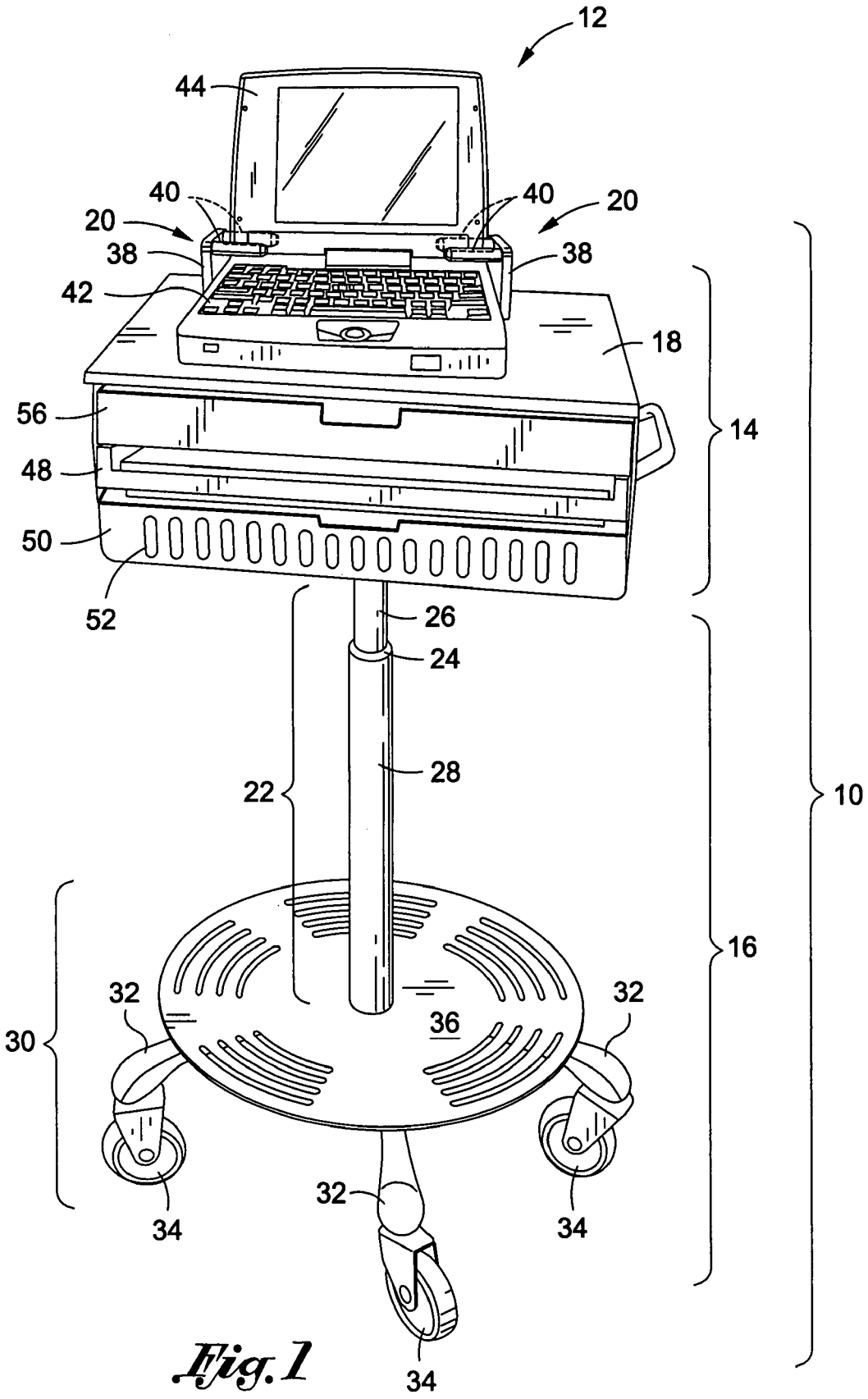
FIG. 1 is a perspective view of a portable laptop computer stand illustrating a support assembly mounted on top of a pedestal.

FIG. 1 shows a portable laptop computer stand 10 that is specifically adapted for allowing transportability of a laptop computer 12 or other device as may be required in a medical institution. In its broadest sense, the portable laptop computer stand 10 comprises a support assembly 14 mounted atop a pedestal 16. The support assembly 14 itself includes a support panel 18 which is specifically adapted for secured mounting of a laptop computer 12 via a pair of security devices 20 disposed on opposing sides of the laptop computer 12 to prevent its removal (i.e., theft).

The pedestal 16 itself comprises a post 22 having a telescopic mechanism 24 interposed therewithin in order to provide height adjustment via a height adjustment lever (not shown). The telescopic mechanism 24 itself comprises a piston 26 which is axially reciprocative within a cylinder 28 which itself is mounted atop a base assembly 30. The base assembly 30 comprises a plurality of radially outwardly extending spokes 32 each having a castor 34 or wheel mounted on a free end thereof. The castors 34 may optionally be provided with a lockable mechanism (i.e., a wheel lock or brake) such that at least one and, more preferably, two or three of the castors 34 are lockable to prevent inadvertent movement of the portable laptop computer stand 10. Optionally, a foot rest 36 may be mounted atop the spokes 32 in order to provide a resting place for the user's foot.

The security devices 20 shown in FIG. 1 are configured to be mountable to the support panel 18 at a spacing greater than the width of the laptop computer 12 to be secured. The security devices 20 are comprised of a vertical member 38 having at least one aperture (not shown) extending upwardly thereinto and at least two elongate prongs 40, preferably cylindrically-shaped, which extend outwardly from at least one of an opposing pair of side surfaces of the security device 20 at a height greater than the height of the keyboard 42 of the laptop computer 12. Ideally, the prongs 40 have a length ranging from about two inches to about four inches, with a preferred length of approximately two and one-half inches. In this manner, the security devices 20 secure the laptop computer 12 and prevents its removal from the support panel 18 while the laptop computer 12 is in the open configuration (e.g., when the display monitor 44 is oriented angularly relative to the keyboard 42 of the laptop computer 12).

It is contemplated that the spacing between the prongs 40 on each of the vertical members 38 may allow a user to selectively adjust the pivotal or angular orientation of the display monitor 44 relative to the keyboard 42 by as much as ninety degrees although various other angular pivotal ranges are contemplated. For example, the spacings between the prongs 40 may be such to allow a user to adjust the pivotal orientation of the display monitor 44 relative to the keyboard 42 by up to thirty degrees.

As shown in FIG. 1, the support assembly may include an internal compartment located below the pull-out keyboard tray 48 to provide an additional volume 50 which may be occupied by laptop accessories such as an additional battery in order to allow for self-sufficient powering or extended duration operation of the laptop computer 12. A plurality of vent holes 52 may be provided in a front end of the internal compartment in order to facilitate cooling of the volume 50 of the internal compartment.

Figure 2:
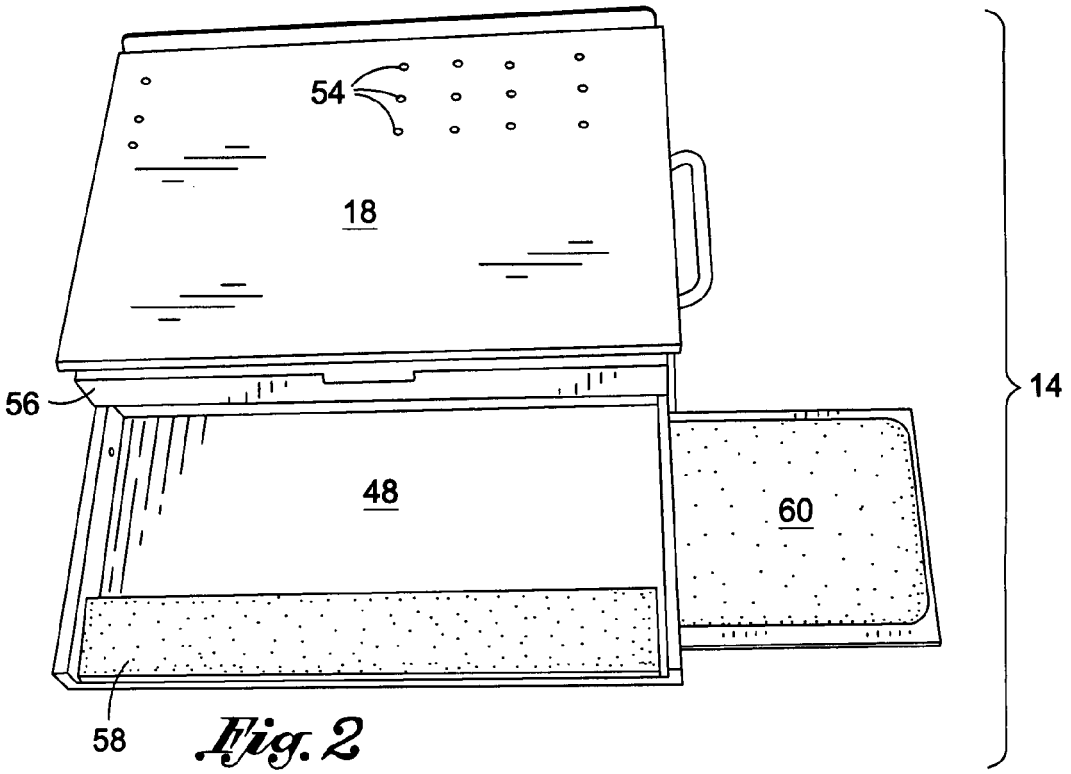
FIG. 2 is a perspective view of the support assembly illustrating the pull-out keyboard tray having a palm rest exposed therealong and illustrating the pull-out mouse tray in an operative position.
Figure 3:
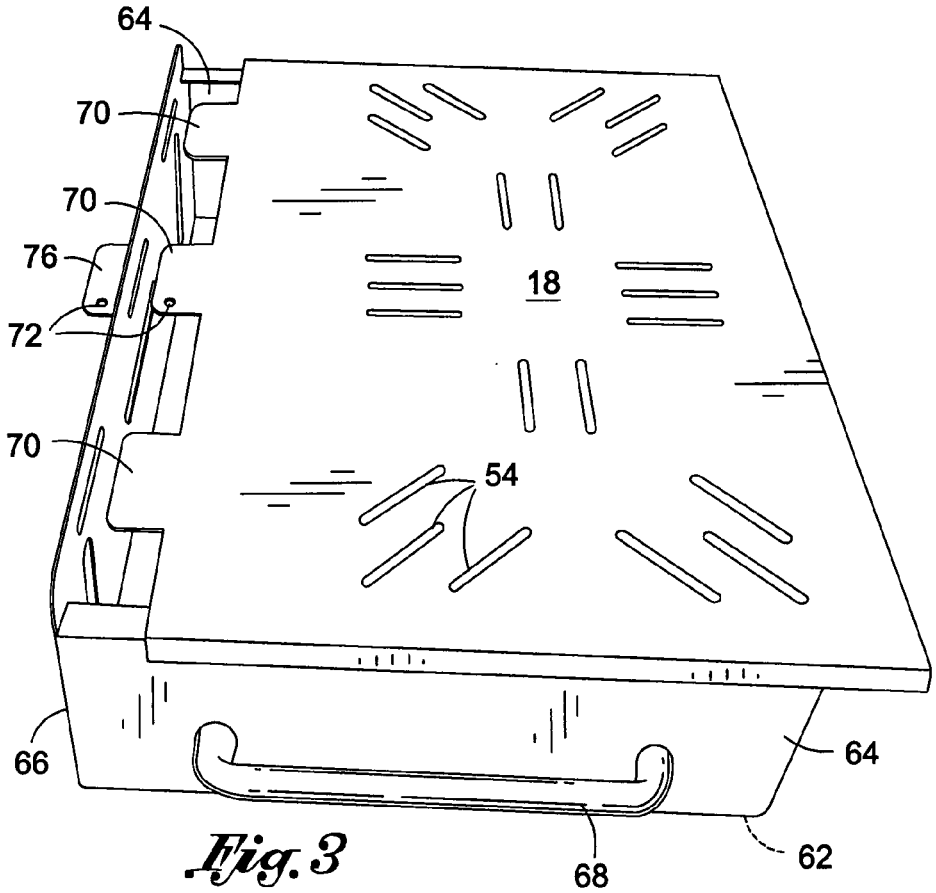
FIG. 3 is a perspective view of a support panel partially disassembled from the support assembly and illustrating a plurality of tabs extending from a rear of the support panel for securement thereof to the support assembly.

As shown in FIGS. 2 and 3, the support assembly 14 includes the support panel 18 upon which the security devices 20 may be mounted. Advantageously, the support panel 18 may include a plurality of slots and/or holes 54 extending therethrough which are of pre-determined spacing to correspond to the spacings between apertures formed in the security devices 20. In addition, the slots and/or holes 54 of the support panel 18 are preferably formed in a plurality of spacings, locations and orientations to allow mounting of the security devices 20 in a variety of positions in order accommodate the varying widths of laptop computers 12 or other devices that can be installed on the support panel 18.

Figure 4:
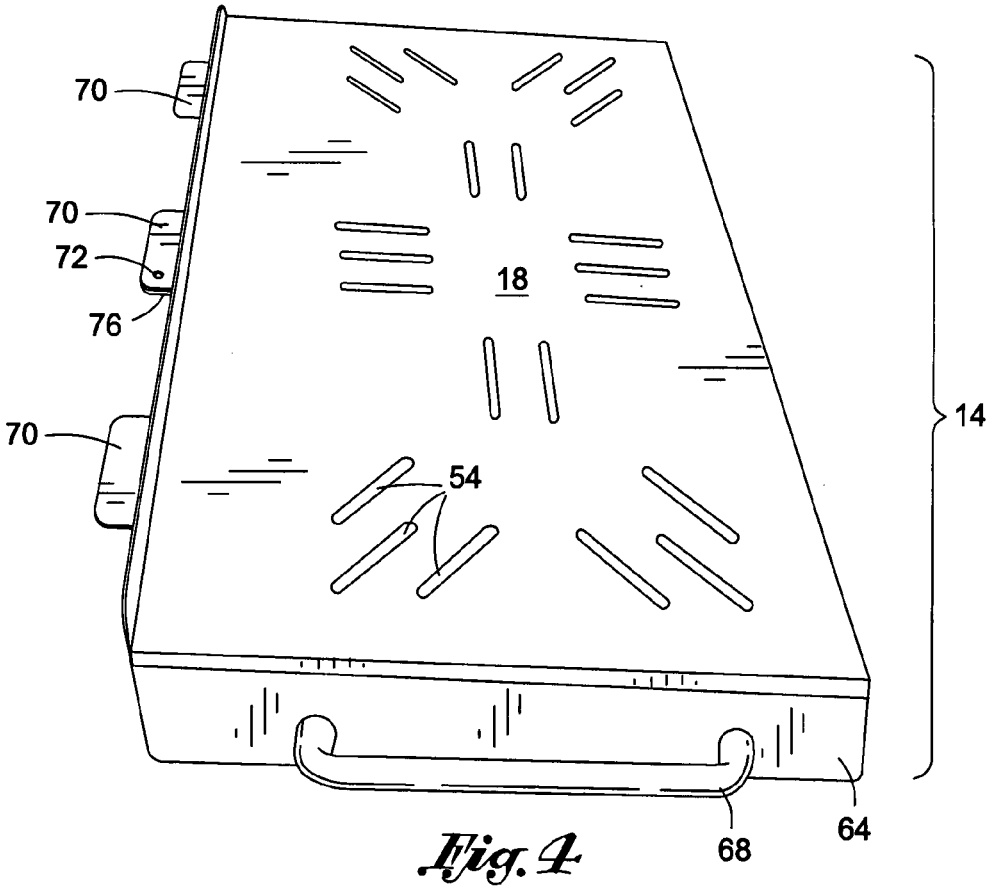
FIG. 4 is a perspective view of the support panel shown mounted atop side walls and a back wall of the support assembly wherein complementary mating tabs of the back wall and the tab of the support panel are aligned with one another.
Figure 5:
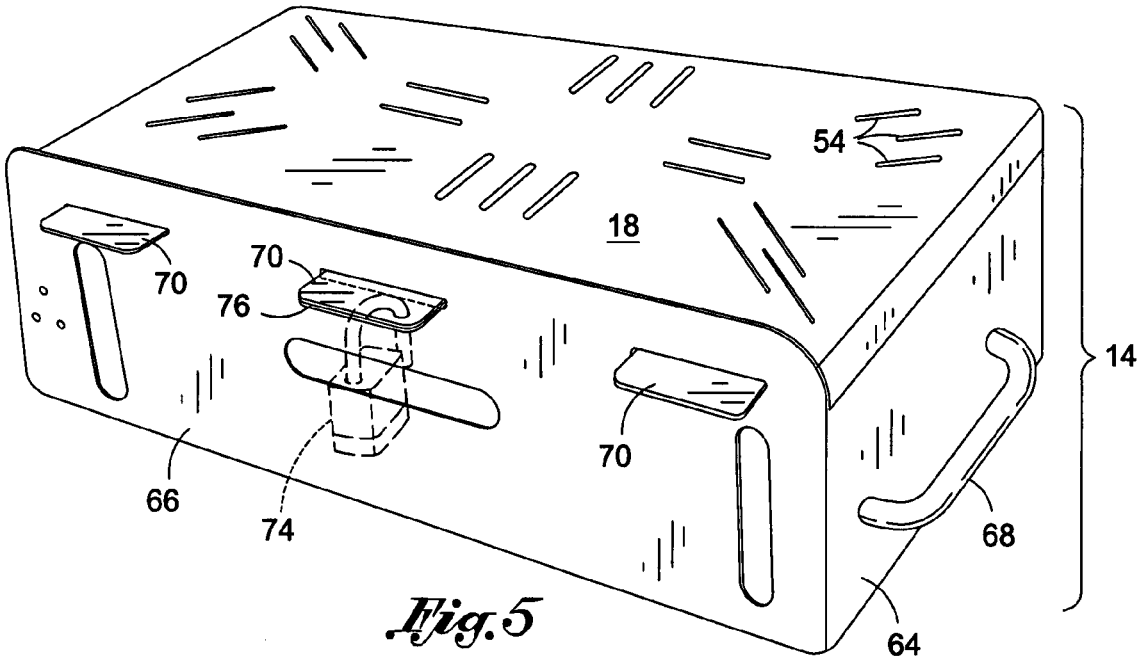
FIG. 5 is a perspective view of the rear of the support assembly illustrating the tabs of the support panel and back wall being aligned with one another and having a locking mechanism such as a padlock extending through a pair of axially aligned holes.

As shown in FIGS. 3-5, the plurality of the slots 54 are preferably formed in various combinations of orientations such as in parallel orientation to the sides of the support panel 18 and/or in non-parallel orientation to the sides of the support panel 18 as exemplified in FIGS. 3-5. The security devices 20 are secured to the support panel 18 by extending mechanical fasteners (not shown) through an appropriate set of the slots and/or holes 54 formed in the support panel 18 in order to attach the security devices 20 to the support panel 18.

The support assembly 14 may optionally include a pull-out drawer 56 for storing various items such as medicines, medical documents and the like. Additionally, a pull-out keyboard tray 48 may be included with the support assembly 14 and may further include a palm rest 58 extending laterally across a width of the pull-out keyboard tray 48. Like the pull-out drawer 56 disposed above the pull-out keyboard tray 48, a pair of sliding mechanisms of the type utilized for drawer slides may be disposed on opposing sides of the pull-out drawer 56 and pull-out keyboard tray 48 in order to facilitate opening and closing of the pull-out drawer 56 and pull-out keyboard tray 48. Optionally, a pull-out mouse tray 60 may be mounted underneath the pull-out keyboard tray 48. The mouse tray 60 may be extended laterally outwardly in order to facilitate use of a mouse which may be operatively connected to the laptop computer 12.

The support assembly 14 itself may be generally rectangularly or orthogonally shaped and is generally bounded by a bottom panel 62 which is mounted upon the pedestal, and a pair of opposing side walls 64 interconnected by a back wall 66. The side walls 64 may each include a handle 68 in order to facilitate maneuvering of the portable laptop computer stand 10 as well as to facilitate lifting thereof. Although shown as being generally rectangularly shaped, the support assembly 14 may be provided in any shape, size or configuration suitable for securing a device such as a laptop computer to the support assembly 14.

As can be seen in FIGS. 3-5, the support panel 18 may include at least one and, more preferably, a plurality of tabs 70 extending from a rearward portion thereof. At least one of the tabs 70 formed in the support panel 18, as shown in FIG. 3, is preferably configured to align with a mating tab 76 extending outwardly from the back wall 66. Advantageously, the tab 70 and mating tab 76 are provided with axially aligned holes 72 in order to allow insertion or engagement of a locking mechanism 74 such as a padlock, combination lock, key lock or other suitable locking mechanism. Such an arrangement allows for securing the support panel 18 to the support assembly 14 to prevent slidable removal of the support panel 18 and access to the mechanical fasteners extending into the security devices 20 from the lower surface of the support panel 18. More specifically, the mechanical fasteners extending upwardly from an inner side of the support panel 18 attach the security devices 20 to the support panel shown in FIG. 1.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A mobile workstation for supporting a laptop computer having a laptop width and comprising a display monitor pivotally connectable to a keyboard, the display monitor being moveable between open and closed positions, the display monitor and keyboard each having a thickness, the mobile workstation comprising:

a pedestal having a post mounted on a wheeled base assembly, the post having a telescopic mechanism configured to provide selective height adjustability of the laptop computer;

a support assembly having a support panel for supporting the laptop computer thereupon, the support assembly further having a pull-out drawer, a pull-out keyboard tray having a pull-out mouse tray, the drawer, keyboard tray and mouse tray each having a sliding mechanism to allow slidable opening and closing thereof, the support assembly comprising a bottom panel mounted on the pedestal and having a pair of opposing side walls interconnected by a back wall;

a pair of security devices being configured to be mountable to the support panel at a spacing greater than the laptop width, each of the locking fixtures comprising:

a vertical member having a lower surface and at least one side surface, the lower surface having at least one aperture extending upwardly thereinto;

at least two elongated prongs extending laterally outwardly from the side surface and being located above the lower surface at a height greater than a thickness of the keyboard and being spaced from one another at a distance greater than a thickness of the display monitor;

wherein:

the at least two prongs extending from respective ones of the vertical members being oriented in facing relationship to one another;

the aperture of each one of the security devices being adapted to receive a mechanical fastener to secure the security devices to the support panel;

the support panel resting on the side walls and being lockable to the back wall such that access to the mechanical fasteners securing the security devices to the support panel is prevented.

2. The mobile workstation of claim 1 wherein each one of the lower surfaces of each security device has a pair of the apertures extending upwardly thereinto and being adapted to receive a pair of the mechanical fasteners.

3. The mobile workstation of claim 2 wherein the support panel includes holes formed therethrough at a spacing complementary to the spacing between the apertures of respective ones of the security devices, the apertures being threaded and being adapted to threadably receive the mechanical fasteners.

4. The mobile workstation of claim 3 wherein the holes are preferably formed in a plurality of spacings and locations to allow for flexibility and accommodation when mounting the laptop computer.

5. The mobile workstation of claim 1 wherein:

the lower surface of each one of the vertical members is substantially planar;

the support panel being substantially planar such that the lower surface may be placed in abutting contact therewith.

6. The mobile workstation of claim 1 wherein the spacing between the prongs of each one of the security devices is such that the display monitor may pivot.

7. The mobile workstation of claim 1 wherein each prong has a tapered end.

8. The support assembly of claim 1 wherein the support panel and back wall each have at least one tab extending laterally outwardly therefrom with a hole being formed in corresponding positions on each of the tabs for receiving a locking mechanism for locking the support panel to the back wall.

9. A mobile workstation for transporting a laptop computer, the laptop computer having a laptop width and comprising a display monitor pivotally connectable to a keyboard and being moveable between open and closed positions, the display monitor and keyboard each having a thickness, the mobile workstation comprising:

a pedestal having a post; and a support assembly having a support panel for supporting the laptop computer thereupon, the support assembly having a pair of opposing side walls interconnected by a back wall;

the support panel and back wall each having at least one tab extending laterally outwardly therefrom with a hole being formed in corresponding positions on each of the tabs for receiving a locking mechanism for locking the support panel to the back wall.

10. The mobile workstation of claim 9, further comprising:

the support assembly further having a pull-out drawer and a pull-out keyboard tray, the drawer and keyboard tray each having a sliding mechanism to allow slidable opening and closing thereof;

wherein the pull-out keyboard tray includes a pull-out mouse tray which is slidably mounted and laterally extendable from the pull-out keyboard tray, the mouse tray having a sliding mechanism to allow slidable opening and closing thereof.

11. A mobile workstation for transporting a laptop computer, the laptop computer having a laptop width and comprising a display monitor pivotally connectable to a keyboard and being moveable between open and closed positions, the display monitor and keyboard each having a thickness, the mobile workstation comprising:

a pedestal having a post mounted on a wheeled base assembly; and a support assembly having a support panel for supporting the laptop computer thereupon, the support assembly further having a pull-out drawer and a pull-out keyboard tray, the drawer and keyboard tray each having a sliding mechanism to allow slidable opening and closing thereof, the support assembly comprising a bottom panel mounted on the pedestal and having a pair of opposing side walls interconnected by a back wall;

wherein the support panel and back wall each have at least one tab extending laterally outwardly therefrom with a hole being formed in corresponding positions on each of the tabs for receiving a locking mechanism for locking the support panel to the back wall.

12. A support assembly for a mobile workstation for supporting a laptop computer, the laptop computer having a laptop width and comprising a display monitor pivotally connectable to a keyboard and being moveable between open and closed positions, the display monitor and keyboard each having a thickness, the support assembly comprising:

a support panel for supporting the laptop computer; and wherein the support panel is supported by the side walls;

wherein the support panel is configured to be supported by the side walls;

the support panel and back wall each having at least one tab extending laterally outwardly therefrom with a hole being formed in corresponding positions on each of the tabs for receiving a locking mechanism for locking the support panel to the back wall.

13. The support assembly of claim 12, further comprising:

a pull-out drawer and a pull-out keyboard tray, the drawer and keyboard tray each having a sliding mechanism to allow slidable opening and closing thereof;

wherein the pull-out keyboard tray includes a pull-out mouse tray which is slidably mounted and laterally extendable from the pull-out keyboard tray, the mouse tray having a sliding mechanism to allow slidable opening and closing thereof.

14. The support assembly of claim 12, wherein the support panel includes holes formed therethrough at preformed spacings for selective mounting of at least one security device for securing the laptop computer to the support assembly.

15. The support assembly of claim 14, wherein the holes are preferably formed in a plurality of spacings, locations and orientation to allow for selective positioning of the laptop computer on the support panel.

16. The support assembly of claim 12, wherein the support panel includes slots formed therethrough at preformed spacings for selective mounting of at least one security device for securing the laptop computer to the support assembly.

17. The support assembly of claim 16, wherein the slots are preferably formed in a plurality of spacings, locations and orientation to allow for selective positioning of the laptop computer on the support panel.

18. The support assembly of claim 13, wherein the pull-out keyboard tray includes a pull-out mouse tray which is slidably mounted and laterally extendable from the pull-out keyboard tray, the mouse tray having a sliding mechanism to allow slidable opening and closing thereof.

19. A support assembly for a mobile workstation for supporting a laptop computer, the laptop computer having a laptop width and comprising a display monitor pivotally connectable to a keyboard and being moveable between open and closed positions, the display monitor and keyboard each having a thickness, the support assembly comprising:

a support panel for supporting the laptop computer;

a pull-out drawer and a pull-out keyboard tray, the drawer and keyboard tray each having a sliding mechanism to allow slidable opening and closing thereof; and a bottom panel having a pair of opposing side walls interconnected by a back wall;

wherein:

the support panel is supported by the side walls;

the support panel and back wall each have at least one tab extending laterally outwardly therefrom with a hole being formed in corresponding positions on each of the tabs for receiving a locking mechanism for locking the support panel to the back wall.

* * * * *